US010657888B2

(12) United States Patent
Gao et al.

(10) Patent No.: US 10,657,888 B2
(45) Date of Patent: May 19, 2020

(54) DRIVING METHOD FOR PIXEL DRIVING CIRCUIT, DISPLAY PANEL AND DISPLAY DEVICE

(71) Applicant: SHANGHAI TIANMA AM-OLED CO., LTD., Shanghai (CN)

(72) Inventors: Yana Gao, Shanghai (CN); Xingyao Zhou, Shanghai (CN); Yue Li, Shanghai (CN); Chang-ho Tseng, Xiamen (CN); Yuan Li, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 81 days.

(21) Appl. No.: 15/966,129

(22) Filed: Apr. 30, 2018

(65) Prior Publication Data

US 2019/0266943 A1 Aug. 29, 2019

(30) Foreign Application Priority Data

Feb. 27, 2018 (CN) ..... 2018 1 0161502

(51) Int. Cl.
*G09G 3/3233* (2016.01)

(52) U.S. Cl.
CPC ..... *G09G 3/3233* (2013.01); *G09G 2310/08* (2013.01); *G09G 2320/0233* (2013.01); *G09G 2320/045* (2013.01)

(58) Field of Classification Search
CPC ..... G09G 3/3233; G09G 2320/045; G09G 2320/0233; G09G 2310/08; G09G 3/30
See application file for complete search history.

(56) References Cited

U.S. PATENT DOCUMENTS

2007/0080905 A1* 4/2007 Takahara ..... G09G 3/3233 345/76
2015/0187270 A1* 7/2015 Lee ..... G09G 3/3233 345/76

(Continued)

FOREIGN PATENT DOCUMENTS

CN 106531075 A 3/2017
CN 106531076 A 3/2017

(Continued)

OTHER PUBLICATIONS

Machine translation of WO 2019/119616 A1 (Year: 2019).*

*Primary Examiner* — Patrick N Edouard
*Assistant Examiner* — Joseph P Fox
(74) *Attorney, Agent, or Firm* — Anova Law Group PLLC

(57) ABSTRACT

A driving method for a pixel driving circuit comprising a driving transistor and a light-emitting element is provided. The driving method comprises: in response to a first scanning signal on a first scanning signal line, performing initialization of the pixel driving circuit; in response to a second scanning signal on a second scanning signal line and the first scanning signal on the first scanning signal line, compensating threshold voltage deviation of the driving transistor and providing a data signal voltage; in response to a first light-emitting signal on a first light-emitting signal line and a second light-emitting signal on a second light-emitting signal line, generating, by the driving transistor, driving current corresponding to the data signal voltage; and in response to the driving current, emitting light by the light-emitting element. At least one clock signal period is provided after initialization is completed and before the threshold voltage deviation is compensated.

17 Claims, 9 Drawing Sheets

(56) References Cited

U.S. PATENT DOCUMENTS

| | | | | |
|---|---|---|---|---|
| 2015/0294619 | A1* | 10/2015 | Lee | G09G 3/3266 345/77 |
| 2017/0263187 | A1* | 9/2017 | Zhu | G09G 3/3233 |

FOREIGN PATENT DOCUMENTS

| | | | | |
|---|---|---|---|---|
| CN | 107154239 | A | 9/2017 | |
| CN | 107680537 | A | 2/2018 | |
| JP | 2009271320 | A | 11/2009 | |
| WO | WO-2019119616 | A1 * | 6/2019 | G09G 3/3233 |

* cited by examiner

DRIVING METHOD FOR PIXEL DRIVING CIRCUIT, DISPLAY PANEL AND DISPLAY DEVICE

CROSS-REFERENCES TO RELATED APPLICATIONS

This application claims the priority of Chinese Patent Application No. 201810161502.0, filed on Feb. 27, 2018, the entire contents of which are incorporated herein by reference.

FIELD OF THE DISCLOSURE

The present disclosure generally relates to the display technology and, more particularly, relates to a driving method for pixel driving circuit, display panel and display device.

BACKGROUND

An existing display panel often includes a plurality of rows of pixels, and the pixels include light-emitting elements. Existing technologies adopt thin film transistors (TFTs) to construct a pixel circuit which provides corresponding current to the light-emitting elements.

However, when a large number of thin film transistors are fabricated on a large size glass substrate, due to a difference in technical parameters, a threshold voltage difference is likely to occur between different thin film transistors. In addition, during the operation of the display panel, a long-time bias state causes a threshold voltage drift of the thin film transistor, which further aggravates the threshold voltage difference of different thin film transistors, thereby resulting in poor luminance uniformity of the display panel. In existing technologies, a threshold voltage compensation stage is often configured in the pixel driving circuit to suppress the threshold voltage difference, and the threshold voltage compensation stage is often arranged during a time period where the light-emitting signal line is emitting the light-emitting signal EMIT. However, for different rows of pixel driving circuits, due to the difference in parasitic capacitance and threshold voltage, the signal intensity of the light-emitting signal EMIT will vary, thereby affecting the degree of threshold compensation and the final luminance of the light-emitting elements.

Therefore, in the existing display panels, the compensation performance of the threshold voltage is substantially poor, which leads to the brightness difference of the pixels in different rows, the formation of horizontal stripes on the display screen, and the display unevenness of the display screen. Accordingly, the display performance of the display panel is degraded.

The disclosed driving method for pixel driving circuit, display panel and display device thereof are directed to solve one or more problems set forth above and other problems.

BRIEF SUMMARY OF THE DISCLOSURE

One aspect of the present disclosure provides a driving method for a pixel driving circuit comprising a driving transistor and a light-emitting element. The driving method comprises: in response to a first scanning signal on a first scanning signal line, performing an initialization of the pixel driving circuit; in response to a second scanning signal on a second scanning signal line and the first scanning signal on the first scanning signal line, compensating a threshold voltage deviation of the driving transistor, and providing a data signal voltage; in response to a first light-emitting signal on a first light-emitting signal line and a second light-emitting signal on a second light-emitting signal line, generating, by the driving transistor, driving current corresponding to the data signal voltage; and in response to the driving current, emitting light by the light-emitting element. At least one clock signal period is provided after the initialization of the pixel driving circuit is completed and before the threshold voltage deviation of the driving transistor is compensated.

Another aspect of the present disclosure provides a driving method for a pixel driving circuit comprising a driving transistor, a light-emitting element, a first transistor, a second transistor, a third transistor, a fourth transistor, a fifth transistor, and a sixth transistor, wherein a gate electrode of the first transistor is electrically connected to a first light-emitting signal line, a first electrode of the first transistor is electrically connected to a first voltage signal line, and a second electrode of the first transistor is electrically connected to a first electrode of the driving transistor; a gate electrode of the second transistor is electrically connected to a second light-emitting signal line, a first electrode the second transistor is electrically connected to the first voltage signal line, and a second electrode the second transistor is electrically connected to a second electrode; a gate electrode of the driving transistor is electrically connected to a first node, and the second node is electrically connected to a third node; a gate electrode of the third transistor is electrically connected to a first scanning signal line, a first electrode of the third transistor is electrically connected to the first node, and a second electrode of the third transistor is electrically connected to the third node; a gate electrode of the fourth transistor is electrically connected to a second scanning signal line, a first electrode of the fourth transistor is electrically connected to a data signal line, and a second electrode of the fourth transistor is electrically connected to the second node; a gate electrode of the fifth transistor is electrically connected to the second light-emitting signal line, a first electrode of the fifth transistor is electrically connected to the third node, and a second electrode of the fifth transistor is electrically connected to the light-emitting element; and a gate electrode of the sixth transistor is electrically connected to a first scanning signal line, a first electrode of the sixth transistor is electrically connected to an initialization signal line, and a second electrode of the sixth transistor is electrically connected to the light-emitting element. The driving method comprises: in response to a first scanning signal on the first scanning signal line, performing an initialization of the pixel driving circuit; in response to a second scanning signal on the second scanning signal line and the first scanning signal on the first scanning signal line, compensating a threshold voltage deviation of the driving transistor, and providing a data signal voltage; in response to a first light-emitting signal on the first light-emitting signal line and a second light-emitting signal on the second light-emitting signal line, generating, by the driving transistor, driving current corresponding to the data signal voltage; and in response to the driving current, emitting light by the light-emitting element. At least one clock signal period is provided after the initialization of the pixel driving circuit is completed and before the threshold voltage deviation of the driving transistor is compensated.

Another aspect of the present disclosure provides a display panel comprising a plurality of pixel driving circuits, wherein a pixel driving circuit of the plurality of pixel driving circuits comprises a driving transistor and a light-emitting element, and is driven by a driving method comprising: in response to a first scanning signal on a first scanning signal line, performing an initialization of the pixel driving circuit; in response to a second scanning signal on a second scanning signal line and the first scanning signal on the first scanning signal line, compensating a threshold voltage deviation of the driving transistor, and providing a data signal voltage; and in response to a first light-emitting signal on a first light-emitting signal line and a second light-emitting signal on a second light-emitting signal line, generating, by the driving transistor, driving current corresponding to the data signal voltage, and in response to the driving current, emitting light by the light-emitting element, wherein at least one clock signal period is provided after the initialization of the pixel driving circuit is completed and before the threshold voltage deviation of the driving transistor is compensated. The display panel comprises: a display area including a plurality of pixel units arranged in an array, a plurality of light-emitting signal lines, and a plurality of scanning signal lines; and a non-display area including a first scanning signal control circuit, a second scanning signal control circuit, and a light-emitting signal control circuit. A pixel unit of the plurality of pixel units includes the pixel driving circuit. The plurality of scanning signal lines include a plurality of first scanning signal lines and a plurality of second scanning signal lines, and the pixel driving circuits in the same row are electrically connected to a first scanning signal line and a second scanning signal line. The first scanning signal control circuit is electrically connected to the plurality of first scanning signal lines, the second scanning signal control circuit is electrically connected the plurality of second scanning signal lines. The light-emitting signal control circuit is electrically connected to the plurality of light-emitting signal lines.

Another aspect of the present disclosure provides a display device comprising the disclosed display panel.

Other aspects of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Figure 1:
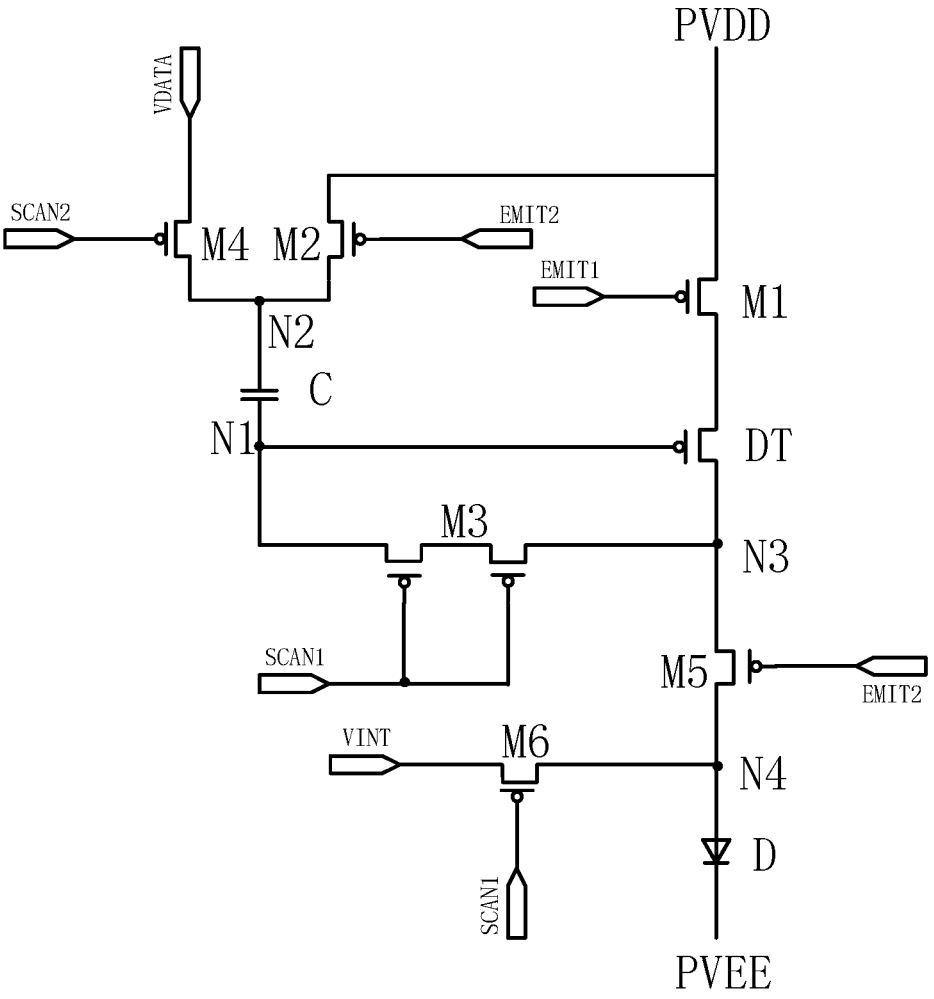
FIG. 1 illustrates a circuit diagram of an existing pixel driving circuit.

Reference will now be made in detail to exemplary embodiments of the disclosure, which are illustrated in the accompanying drawings. Hereinafter, embodiments consistent with the disclosure will be described with reference to drawings. In the drawings, the shape and size may be exaggerated, distorted, or simplified for clarity. Wherever possible, the same reference numbers will be used throughout the drawings to refer to the same or like parts, and a detailed description thereof may be omitted.

Further, in the present disclosure, the disclosed embodiments and the features of the disclosed embodiments may be combined under conditions without conflicts. It is apparent that the described embodiments are some but not all of the embodiments of the present disclosure. Based on the disclosed embodiments, persons of ordinary skill in the art may derive other embodiments consistent with the present disclosure, all of which are within the scope of the present disclosure.

Figure 2:
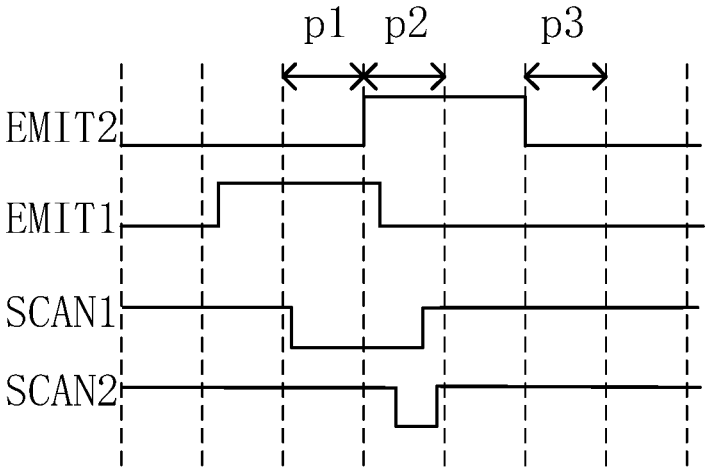
FIG. 2 illustrates a timing diagram of the pixel driving circuit in FIG. 1.

FIG. 1 illustrates a circuit diagram of an existing pixel driving circuit. FIG. 2 illustrates a timing diagram of the pixel driving circuit in FIG. 1.

As shown in FIGS. 1-2, the pixel driving circuit includes a driving transistor DT, a light-emitting element D, a first transistor M1, a second transistor M2, a third transistor M3, a fourth transistor M4, a fifth transistor M5, a sixth transistor M6 and a capacitor C. The pixel driving circuit includes three operation stages: p1 stage, p2 stage, and p3 stage, among which the p2 stage is the threshold voltage compensation stage.

In the p2 stage, the first scanning signal line SCAN1 is provided with a low-level signal, the second scanning signal line SCAN2 is provided with a low-level signal, the second light-emitting signal line EMIT2 is provided with a high-level signal, and the first light-emitting signal line EMIT1 is provided with a low-level signal. The low-level signal is a signal under which a PMOS (P-channel) transistor can be switched on and a NMOS (N-channel) transistor can be switched off, and the high-level signal is a signal under which a PMOS (P-channel) transistor can be switched off and a NMOS (N-channel) transistor can be switched on.

According to the operation principle that PMOS (P-channel) transistor is switched on under the low-level signal, the first transistor M1, the third first transistor M3, the fourth transistor M4, and the sixth transistor M6 are switched on, while the second transistor M2 and the fifth transistor M5 are switched off. Because the node N1 is initialized to a low-level, the driving transistor DT is also switched on. At this moment, the data signal line DATA is charging the node N1. The gate potential of the driving transistor DT is gradually elevated, the current flowing through the driving transistor DT is gradually reduced until the potential of the node N1 is raised to a critical condition of switching off the driving transistor DT, i.e. $V_{gs}=V_{N1}-V_{pvdd}=V_{th}$, where $V_{th}$ is the threshold voltage of the driving transistor DT, $V_{gs}$ is the gate-source voltage difference of the driving transistor DT, $V_{pvdd}$ is the voltage at the first voltage signal line PVDD, and $V_{N1}$ is the voltage at the node N1.

The p2 stage is located on the lower stage (i.e., a stage changing from high-level to low-level) of the first light-emitting signal line EMIT1. The switched-on time (ON time) of the first transistor M1 may be substantially short, leading to insufficient charging time of the node N1. Thus, the potential of the node N1 may not be effectively raised to the critical condition that the driving transistor DT could be switched off, thereby affecting the degree of threshold compensation of the driving transistor DT. In addition, for different rows of pixel driving circuits, due to the influence of parasitic capacitance and threshold difference, the light-emitting signals may exhibit different signal intensities, thereby affecting the degree of threshold compensation and the final light-emitting luminance of the light-emitting element. Thus, the compensation performance of the threshold voltage may be substantially poor, which may lead to brightness differences of pixels in different rows, horizontal stripes on the display screen, display unevenness of the display panel. Accordingly, the display performance may be degraded.

In view of this, the present disclosure provides an improved driving method for the pixel driving circuit in FIG. 1. The disclosed driving method for the pixel driving circuit may adjust the driving scheme of the pixel driving circuit by providing at least one clock signal period after the initialization is completed and before the threshold voltage deviation is compensated. Thus, the timing for capturing the threshold of the driving transistor DT may be arranged away from the lower stage (i.e., a stage changing from high-level to low-level) of the first light-emitting signal line EMIT1. That is, the timing for capturing the threshold of the driving transistor DT may be no longer arranged at the lower stage (i.e., a stage changing from high-level to low-level) of the first light-emitting signal line EMIT1. Thus, the compensation effect of the threshold voltage of the driving transistor DT may be improved, uneven vertical stripes on the display screen may be effectively suppressed, and the display performance may be enhanced accordingly.

Figure 3:
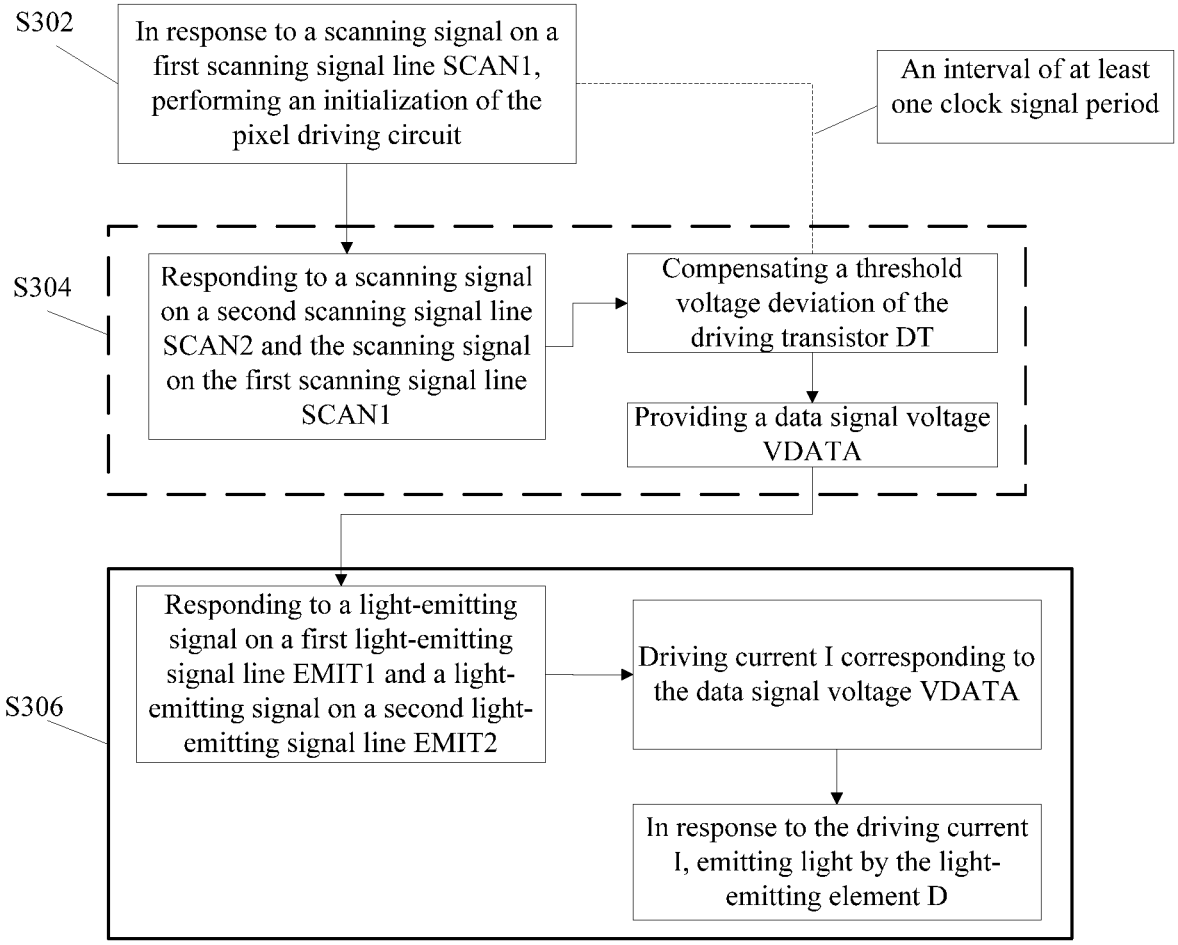
FIG. 3 illustrates a flow chart of an exemplary driving method for pixel driving circuit consistent with disclosed embodiments.
Figure 4:
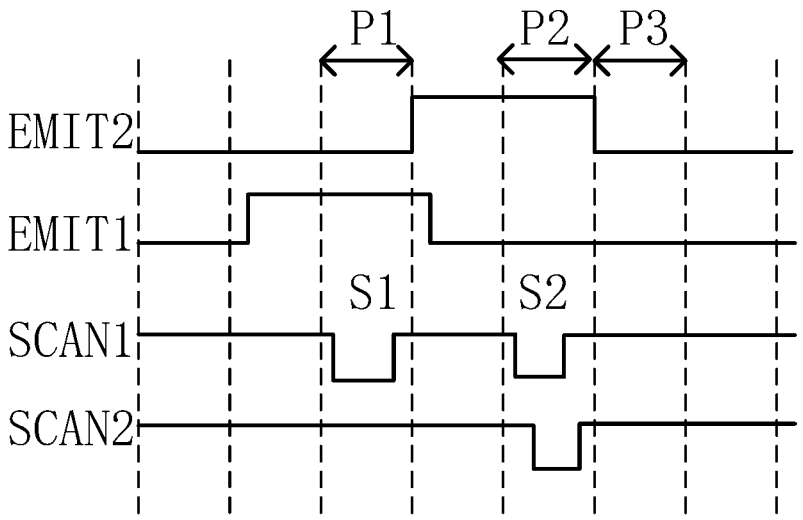
FIG. 4 illustrates a timing diagram of the pixel driving circuit in FIG. 1 when driven by an exemplary driving method consistent with disclosed embodiments.

FIG. 3 illustrates a flow chart of an exemplary driving method for pixel driving circuit consistent with disclosed embodiments, and FIG. 4 illustrates a timing diagram of an existing pixel driving circuit in FIG. 1 when driven by an exemplary driving method consistent with disclosed embodiments.

As shown in FIG. 1, FIG. 3, and FIG. 4, the pixel driving circuit includes a driving transistor DT and a light-emitting element D. The disclosed driving method for pixel driving circuit may comprise the following steps:

Step S302: in response to a first scanning signal on a first scanning signal line SCAN1, performing an initialization of the pixel driving circuit;

Step S304: in response to a scanning signal on a second scanning signal line SCAN2 and the scanning signal on the first scanning signal line SCAN1, compensating a threshold voltage deviation of the driving transistor DT, and providing a data signal voltage VDATA;

Step S306: in response to a light-emitting signal on a first light-emitting signal line EMIT1 and a light-emitting signal on a second light-emitting signal line EMIT2, generating, by the driving transistor DT, driving current I corresponding to the data signal voltage VDATA, and in response to the driving current I, emitting light by the light-emitting element D.

In particular, at least one clock signal period may be provided after the initialization of the pixel driving circuit is completed and before the threshold voltage deviation of the driving transistor is compensated, i.e., after "performing an initialization of the pixel driving circuit" in the Step 302 is completed and before "compensating a threshold voltage deviation of the driving transistor DT" in the Step 304 is started.

In the disclosed embodiments, the driving method for pixel driving circuit may comprise three stages: a first stage, a second stage and a third stage.

At the first stage, the pixel driving circuit may respond to the scanning signal on the first scanning signal line SCAN1 and perform an initialization, i.e., reset the pixel driving circuit.

At the second stage, the pixel driving circuit may respond to the scanning signal on the second scanning signal line SCAN2 and the scanning signal on the first scanning signal line SCAN1, and compensate the threshold voltage deviation of the driving transistor DT, and provide the data signal voltage VDATA, i.e., perform the threshold capture of the driving transistor DT and write the data signal voltage VDATA.

Because the threshold voltage of the driving transistor in the OLED pixel driving circuit is likely to drift, the light-emitting current of the OLED is not uniform. To solve the threshold voltage drift, the pixel driving circuit of the OLED may capture the threshold voltage of the driving transistor. Two methods of capturing the threshold are often used. In the first method, an external IC directly obtains the threshold voltage value, then adjusts the data voltage supplied to the pixel driving circuit according to the obtained threshold voltage value. In the second method, the pixel driving circuit is internally provided with a threshold capture module, which acquires a voltage related to the threshold voltage at the gate electrode of the driving transistor, such that the final driving current generated by the driving transistor is not affected by the threshold voltage. That is, a voltage related to the threshold voltage is first captured, and then the voltage related to the threshold voltage is substituted into the driving current equation to eliminate the influence of the threshold voltage, thereby realizing the threshold compensation. In the disclosed embodiments, the threshold of the driving transistor DT may be captured by the second method, which will be further explained in FIGS. 5-7.

At the third stage, the pixel driving circuit may respond to the light-emitting signal on the first light-emitting signal line EMIT1 and the light-emitting signal on the second light-emitting signal line EMIT2. The driving transistor DT may generate the driving current I corresponding to the data signal voltage VDATA, and the light-emitting element D may emit light in response to the driving current I. That is, in the third stage, the driving transistor DT may be in a switched-on state and generate the driving current I. The driving current may cause the light-emitting element D to emit light.

In the disclosed embodiments, the driving scheme of the pixel driving circuit may be adjusted, i.e. at least one clock signal period may be provided after the initialization is completed and before the threshold voltage deviation is compensated. Thus, the threshold of the driving transistor DT may be captured beyond the lower stage (i.e., a stage changing from high-level to low-level) of the first light-emitting signal line EMIT1 and the second light-emitting signal line EMIT2. Accordingly, the compensation effect of the threshold voltage may be improved, the horizontal stripes may be suppressed, and the display performance may be enhanced.

In one embodiment, refer to FIG. 1, the pixel driving circuit driven by the disclosed driving method may include a first transistor M1, a second transistor M2, a third transistor M3, a fourth transistor M4, a fifth transistor M5, and a sixth transistor M6.

The gate electrode of the first transistor M1 may be electrically connected to the first light-emitting signal line EMIT1, the first electrode of the first transistor M1 may be electrically connected to the first voltage signal line PVDD, and the second electrode of the first transistor M1 may be electrically connected to the first electrode of the driving transistor DT.

The gate electrode of the second transistor M2 may be electrically connected to the second light-emitting signal line EMIT2, the first electrode the second transistor M2 may be electrically connected to the first voltage signal line PVDD, and the second electrode the second transistor M2 may be electrically connected to the second node N2.

The gate electrode of the driving transistor DT may be electrically connected to the first node N1, and the second node N2 and the third node N3 may be electrically connected to each other.

The gate electrode of the third transistor M3 may be electrically connected to the first scanning signal line SCAN1, the first electrode of the third transistor M3 may be electrically connected to the first node N1, and the second electrode of the third transistor M3 may be electrically connected to the third node N3.

The gate electrode of the fourth transistor M4 may be electrically connected to the second scanning signal line SCAN2, the first electrode of the fourth transistor M4 may be electrically connected to the data signal line DATA, and the second electrode of the fourth transistor M4 may be electrically connected to the second node N2.

The gate electrode of the fifth transistor M5 may be electrically connected to the second light-emitting signal line EMIT2, the first electrode of the fifth transistor M5 may be electrically connected to the third node N3, and the second electrode of the fifth transistor M5 may be electrically connected to the light-emitting element D.

The gate electrode of the sixth transistor M6 may be electrically connected to the first scanning signal line SCAN1, the first electrode of the sixth transistor M6 may be electrically connected to the initialization signal line VINT, and the second electrode of the sixth transistor M6 may be electrically connected to the light-emitting element D.

In one embodiment, the transistors in the pixel driving circuit in FIG. 1 may be all PMOS transistors. In another embodiment, the transistors in the pixel driving circuit in FIG. 1 may be all NMOS transistors, or some transistors may be PMOS transistors and other transistors may be NMOS transistors. Assuming all the transistor in the pixel driving circuit are PMOS transistors, the operation of the pixel driving circuit driven by the disclosed driving method will be explained as follows.

Figure 5:
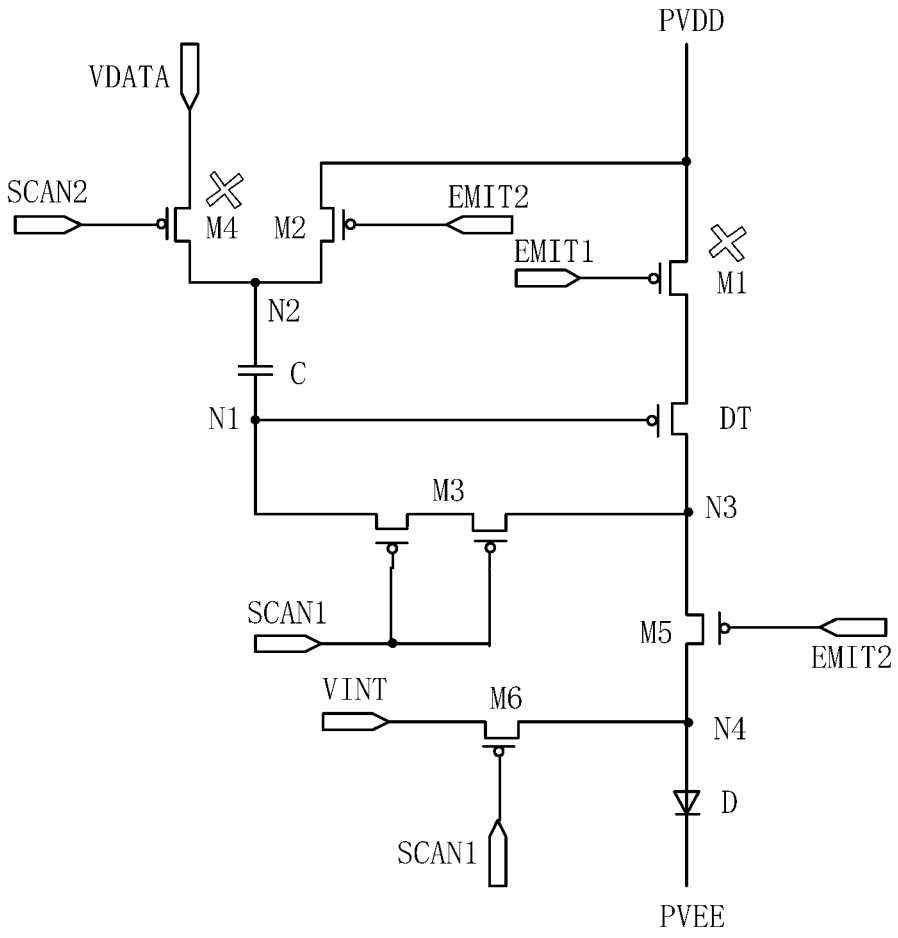
FIG. 5 illustrates on- and off-status of the pixel driving circuit in FIG. 1 in a first stage when driven by an exemplary driving method consistent with disclosed embodiments.

FIG. 5 illustrates on- and off-status of the pixel driving circuit in FIG. 1 in a first stage when driven by an exemplary driving method consistent with disclosed embodiments.

Referring to FIG. 1, FIG. 4, and FIG. 5, at the first stage (i.e., P1 stage), the first scanning signal line SCAN1 may be provided with a low-level signal, the second scanning signal line SCAN2 may be provided with a high-level signal, the second light-emitting signal line EMIT2 may be provided with a low-level signal, the first light-emitting signal line EMIT1 may be provided with a high-level signal. According to the principle that the PMOS is switched on at a low-level signal, M1 and M4 may be switched off, M2, M3, M5 and M6 may be switched on, during which the pixel driving circuit may be reset. The reference voltage VREF may be provided to the first node N1 and the third node N3, where $V_N=V_{N3}=V_{REF}$. Here $V_{REF}$ is often set at a low-level.

Figure 6:
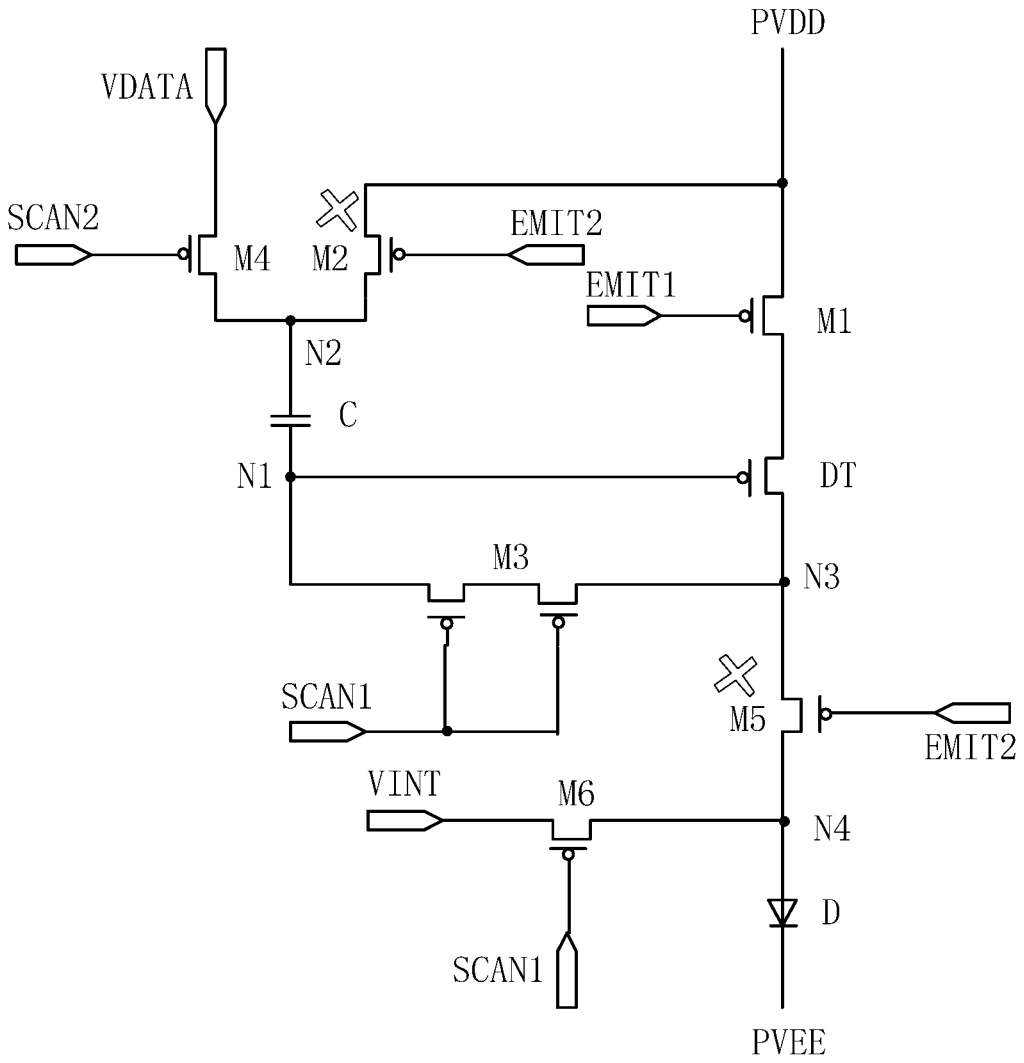
FIG. 6 illustrates on- and off-status of the pixel driving circuit in FIG. 1 in a second stage when driven by an exemplary driving method consistent with disclosed embodiments.

FIG. 6 illustrates on- and off-status of the pixel driving circuit in FIG. 1 in a second stage when driven by an exemplary driving method consistent with disclosed embodiments.

Referring to FIG. 1, FIG. 4, and FIG. 6, at the second stage (i.e., P2 stage), the first scanning signal line SCAN1 may be provided with a low-level signal, the second scanning signal line SCAN2 may be provided with a low-level signal, the second light-emitting signal line EMIT2 may be provided with a high-level signal, the first light-emitting signal line EMIT1 may be provided with a low-level signal. According to the principle that the PMOS is switched on at a low-level signal, M1, M3, M4 and M 6 may be switched on, M2 and M5 may be switched off.

Because node N1 is initialized to be at a low-level, the driving transistor DT may be also switched on, during which the data signal line DATA may charge the node N1, gradually raising the potential at the gate electrode of the driving transistor DT, such that the current flowing through the driving transistor DT may gradually decrease. The data signal line DATA may charge the node N1 until the potential of the node N1 rises to the critical condition of switching off the driving transistor DT. That is, $V_{gs}=V_{N1}-V_{pvdd}=V_{th}$, where $V_{th}$ is the threshold voltage of the driving transistor DT, $V_{gs}$ is the gate-source voltage difference of the driving transistor DT, $V_{pvdd}$ is the voltage at the first voltage signal line PVDD, and $V_{N1}$ is the voltage at the node N1.

Because the threshold voltage of the PMOS TFT is often negative, N1 may be rewritten as $V_{N1}=V_{pvdd}-|V_{th}|$, and at this moment, $V_{N2}$=VDATA. The P2 stage, during which the capture of the threshold of the driving transistor DT and data writing is performed, may be arranged away from the lower stage (i.e., a stage changing from high-level to low-level) of the first light-emitting signal line EMIT1. Thus, uneven vertical stripes (Mura) may be effectively suppressed, and the display performance may be enhanced.

Figure 7:
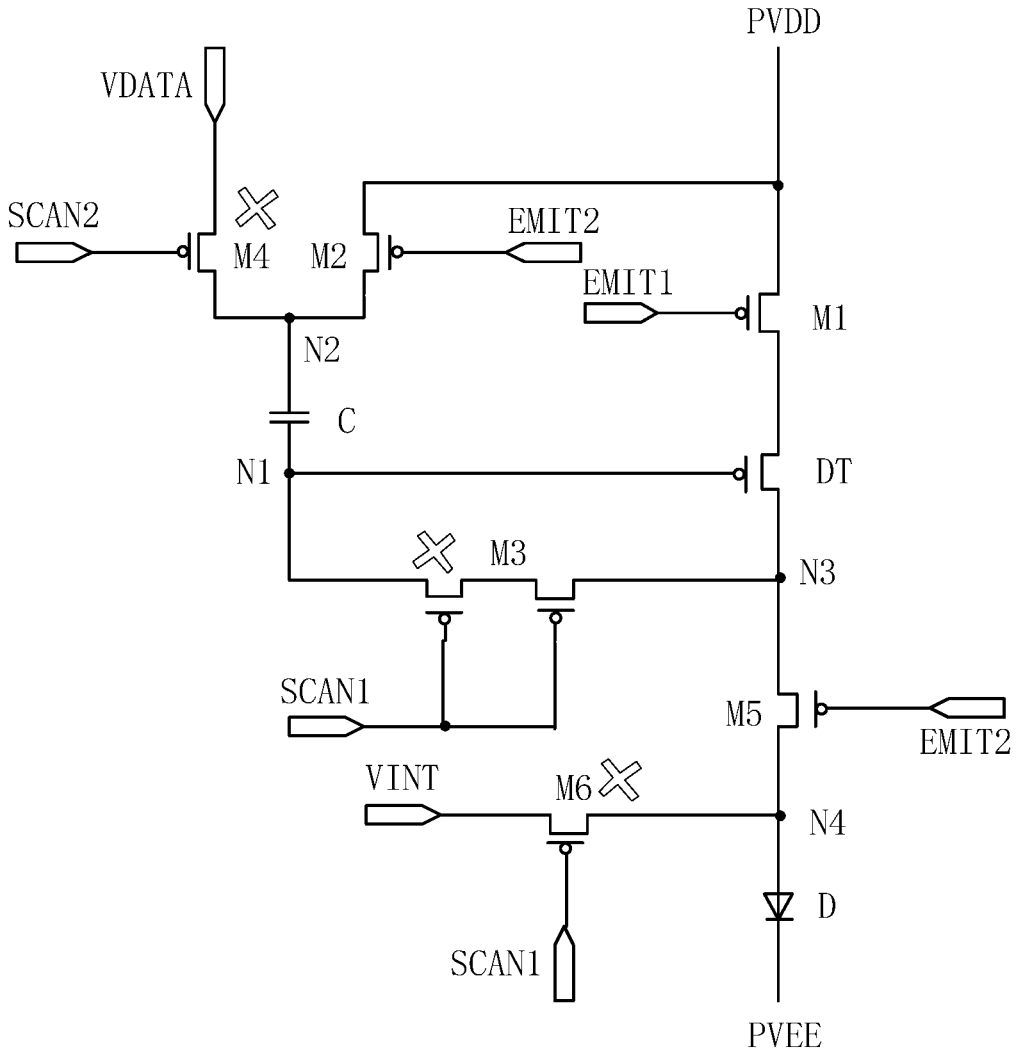
FIG. 7 illustrates on- and off-status of the pixel driving circuit in FIG. 1 in a third stage when driven by an exemplary driving method consistent with disclosed embodiments.

FIG. 7 illustrates on- and off-status of the pixel driving circuit in FIG. 1 in a third stage when driven by an exemplary driving method consistent with disclosed embodiments.

Referring to FIG. 1, FIG. 4 and FIG. 7, at the third stage (i.e., P3 stage, the light-emitting stage of the light-emitting element D), the first scanning signal line SCAN1 may be provided with a high-level signal, and the second scanning signal line SCAN2 may be provided with a high-level signal, the second light-emitting signal line EMIT2 may be provided with a low-level signal, and the first light-emitting signal line EMIT1 may be provided with a low-level signal. According to the principle that the PMOS transistor is switched on at a low-level signal, M1, M2 and M 5 may be switched on, M3, M4 and M6 may be switched off. At this moment, $V_{N2}=V_{PVDD}$, $V_{N2}$ is coupled to the N1 node, then $V_{N1}=2V_{PVDD}-\text{VDATA}-|V_{th}|$.

At the third stage, the current of the driving transistor DT may be calculated according to the following Equation (1):

$$I=K*(V_{gs}-V_{th})^2, \qquad \text{Equation (1)}$$

where K is a constant, $V_{gs}$ is the gate-source voltage difference of the driving transistor DT, $V_{gs}=V_g-V_s$. $V_s$ is the source voltage of the driving transistor DT, in the third stage, $V_s=V_{pvdd}$, where $V_{pvdd}$ is the voltage provided by the first voltage signal line PVDD. $V_g$ is the gate voltage of the driving transistor DT, i.e., the voltage at the first node N1, $V_g=2V_{pvdd}-VDATA-|V_{th}|$.

Therefore, $V_{gs}$ may be calculated according to the following Equation (2):

$$V_{gs}=V_g-V_s=2V_{pvdd}-VDATA-|V_{th}|-V_{pvdd}=V_{pvdd}-VDATA-|V_{th}|, \quad \text{Equation (2)}$$

where $V_{th}$ is the threshold voltage of the driving transistor DT. Because the P-type transistor of the driving transistor DT is taken as an example for illustrative purposes, the threshold voltage of the driving transistor DT is a negative value. Thus, Equation (1) can be rewritten as Equation (3):

$$I=K*(V_{gs}+|V_{th}|)^2, \quad \text{Equation (3)}$$

Through substituting Equation (2) into Equation (3), the following Equation (4) is obtained:

$$I=K*(V_{gs}+|V_{th}|)^2=K*(V_{pvdd}-VDATA-|V_{th}|+V^{th}|)^2=K*(V_{pvdd}-VDATA)^2 \quad \text{Equation (4)}$$

According to Equation (4), the current of the driving transistor DT is independent of the threshold voltage $V_{th}$ of the driving transistor DT, such that in the threshold voltage compensation stage, the threshold voltage $V_{th}$ of the driving transistor DT may be successfully compensated by, for example, a threshold compensation module.

In the disclosed embodiments, at least one clock signal period may be provided after the initialization is completed and before the threshold voltage deviation is compensated, i.e., at least one clock signal period may be provided between the P1 stage and the P3 stage. In one embodiment, as shown in FIG. 4, two clock signal periods may be provided after the initialization is completed and before the threshold voltage deviation is compensated. That is, two clock signal periods may be provided between the P1 stage and the P3 stage. Thus, the timing for capturing the threshold of the driving transistor DT (i.e., the P2 stage) may be arranged away from the lower stage (i.e., a stage changing from high-level to low-level) of the first light-emitting signal line EMIT1. Thus, uneven vertical stripes (Mura) may be effectively suppressed, and the display performance may be enhanced.

In one embodiment, as shown in FIG. 4, the first scanning signal line SCAN1 may provide two adjacent scanning signals S1, S2, and the two scanning signals S1, S2 may be separated by at least one clock signal period.

In particular, in the two adjacent scanning signals S1, S2, the first scanning signal S1 of the first scanning signal line SCAN1 may reset the light-emitting element D in the P1 stage, and the second scanning signal S2 of the first scanning signal line SCAN1 may charge the node N1 in the P2 stage. That is, the two adjacent scanning signals S1, S2 in the first scanning signal line SCAN1 may realize different functions at different stages, and the two scanning signals S1, S2 may be separated by a certain period. The certain period may be at least one clock signal period and, thus, the second scanning signal S2 of the first scanning signal line SCAN1 may be arranged away from the lower stage (i.e., a stage changing from high-level to low-level) of the first light-emitting signal line EMIT1. Accordingly, a smooth capture of the threshold value of the driving transistor DT may be further ensured, and the display performance may be further improved.

In one embodiment, referring to FIG. 1 and FIG. 4, during the at least one clock signal period arranged between the P1 stage and the P3 stage, the signal output from the first light-emitting signal line EMIT1 may include a light-emitting signal. Given the transistors in the pixel driving circuit are all PMOS as an example, the light-emitting signal output from the first light-emitting signal line EMIT1 is a low-level signal.

In one embodiment, during the at least one clock signal period between the P1 stage and the P3 stage, the first light-emitting signal line EMIT1 may only output a low-level signal. In another embodiment, during the at least one clock signal period between the P1 stage and the P3 stage, the first light-emitting signal line EMIT1 may output a signal that changes from a high-level to a low-level (for example, as shown in FIG. 4), which is not limited by the present disclosure.

In one embodiment, referring to FIG. 4, the duty cycle of the light-emitting signal on the first light-emitting signal line EMIT1 may be approximately 25%, and the duty cycle of the light-emitting signal on the second light-emitting signal line EMIT2 may be approximately 25%, which may minimize the power consumption of the pixel driving circuit while ensuring sufficient brightness of the display screen.

The present disclosure also provides a display panel including the pixel driving circuit driven by the disclosed driving method.

Figure 8:
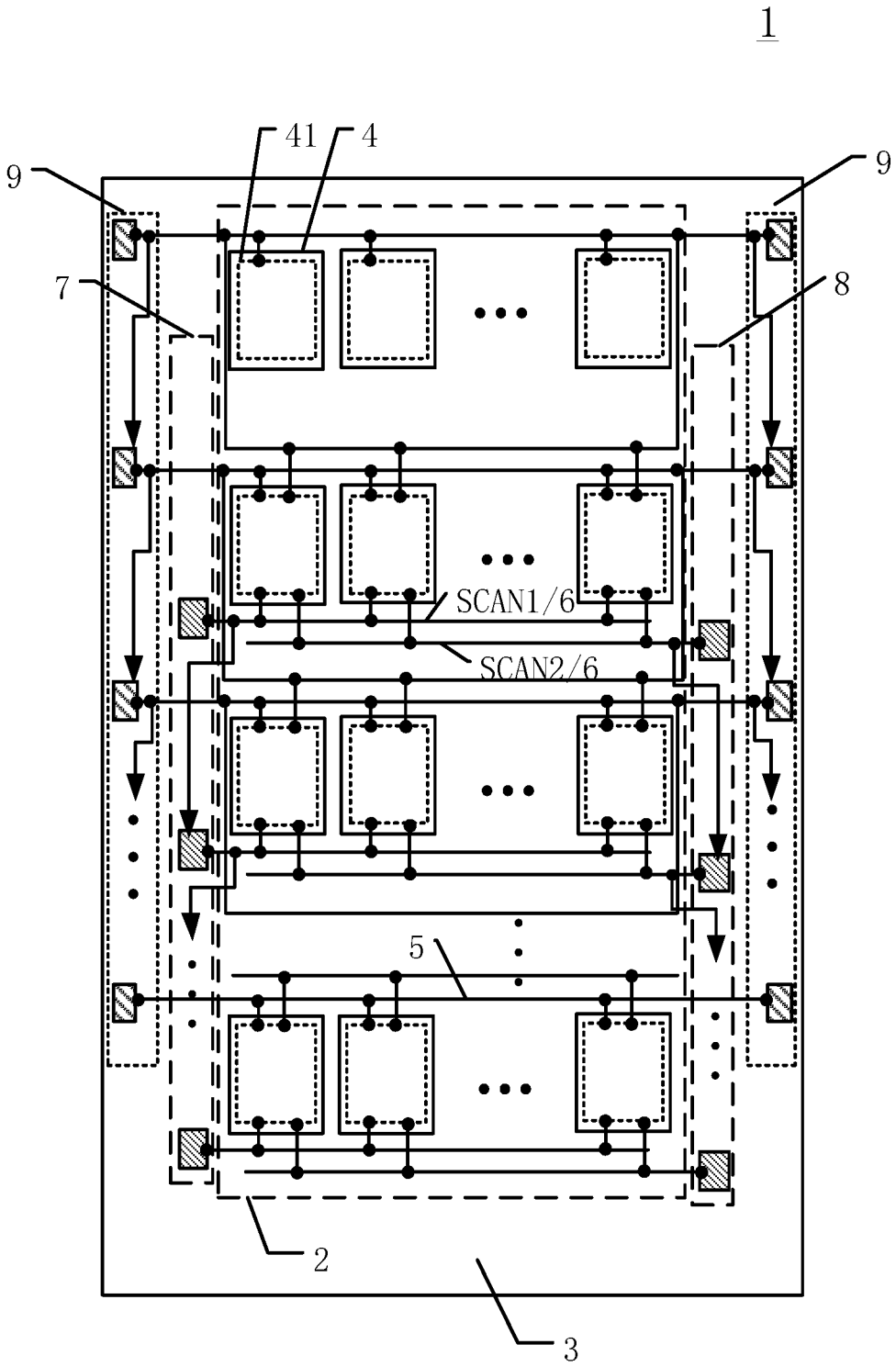
FIG. 8 illustrates a top view of an exemplary display panel consistent with disclosed embodiments.

FIG. 8 illustrates a top view of an exemplary display panel 1 consistent with disclosed embodiments. As shown in FIG. 8, the display panel 1 may include a display area 2 and a non-display area 3. The display area 2 may include a plurality of pixel units 4 arranged in an array, a plurality of light-emitting signal lines 5, and a plurality of scanning signal lines 6. Each pixel unit 4 may include a pixel driving circuit 41. The plurality of scanning signal lines 6 may include a plurality of first scanning signal lines SCAN1 and a plurality of second scanning signal lines SCAN2. The pixel driving circuits 41 in the same row may be electrically connected to one first scanning signal line SCAN1 and one second scanning signal line SCAN2. That is, the pixel driving circuits 41 in the same row may be electrically connected to a same first scanning signal line SCAN1 and a same second scanning signal line SCAN2.

The non-display area 3 may include a first scanning signal control circuit 7 and a second scanning signal control circuit 8. The first scanning signal control circuit 7 may be electrically connected to the first scanning signal lines SCAN1, and the second scanning signal control circuit 8 electrically connected the second scanning signal lines SCAN2. The non-display area 3 may also include a light-emitting signal control circuit 9 electrically connected to the light-emitting signal lines 5.

The display area 2 having display function may include the pixel units 4 for displaying. The non-display area 3 may be configured with wirings, control circuits, and electronic components, etc. The pixel unit 4 may include the pixel driving circuit 41. One first scanning signal line SCAN1 may be only electrically connected to the pixel driving circuits 41 in the same row, and one second scanning signal line SCAN2 may be only electrically connected to the pixel driving circuits 41 in the same row.

The first scanning signal control circuit 7 may provide a voltage signal to the first scanning signal lines SCAN1, and the second scanning signal control circuit 8 may provide a voltage signal to the second scanning signal lines SCAN2. The light-emitting signal control circuit 9 may provide a voltage signal to the light-emitting signal lines 5.

The display panel 1 may be a plasma display panel, a field emission display panel, a light-emitting diode (LED) display panel, an organic light-emitting diode (OLED) display panel, a liquid crystal display panel, a quantum dots (QDs) display panel, an electrophoretic display panel, etc. Further, the display panel 1 may include any appropriate type of display panels having both a display function, which is not limited by the present disclosure.

In one embodiment, referring to FIG. 1, FIG. 4, and FIG. 8, in one frame (a period for displaying one image frame), the first scanning signal line SCAN1 may include two adjust scanning signals S1, S2 separated by a certain interval.

The first scanning signal control circuit 7 may include a plurality of first circuit units 70, the second scanning signal control circuit 8 may include a plurality of second circuit units 80, and the light-emitting signal control circuit 9 may include a plurality of light-emitting circuit units 90. The first row of pixel units in the display panel may be virtual pixel units which are not intended for displaying image information.

In one embodiment, in two adjacent rows of pixel units, the second light-emitting signal line EMIT2 of one row of pixel units may be multiplexed as the first light-emitting signal line EMIT1 of the next row of pixel units.

In one embodiment, in the first scanning signal control circuit 7, the plurality of first circuit units 70 may be electrically connected in a cascade manner. In the second scanning signal control circuit 8, the plurality of second circuit units 80 may be electrically connected in a cascade manner. In the light-emitting signal control circuit 9, the plurality of light emission circuit units 90 may be electrically connected in a cascade manner.

In particular, in the two adjacent scanning signals S1, S2, the first scanning signal S1 of the first scanning signal line SCAN1 may reset the light-emitting element D in the P1 stage, and the second scanning signal S2 of the first scanning signal line SCAN1 may charge the node N1 in the P2 stage. That is, the two adjacent scanning signals S1, S2 in the first scanning signal line SCAN1 may realize different functions at different stages, and the two scanning signals S1, S2 may be separated by a certain period, through which the second scanning signal S2 of the first scanning signal line SCAN1 may be arranged away from the lower stage (i.e., a stage changing from high-level to low-level) of the first light-emitting signal line EMIT1. Thus, a smooth capture of the threshold value of the driving transistor DT may be further ensured, and the display performance may be further improved.

In one embodiment, referring to FIG. 1, FIG. 4 and FIG. 8, the two adjacent scanning signals S1, S2 of the first scanning signal line SCAN1 may be separated by at least one clock signal period. That is, the two scanning signals S1, S2 may be separated by a certain period. The certain period may be at least one clock signal period, through which the timing for capturing the threshold of the driving transistor DT (i.e. S2) may be arranged away from the lower stage (i.e., a stage changing from high-level to low-level) of the first light-emitting signal line EMIT1. Thus, a smooth capture of the threshold value of the driving transistor DT may be further ensured, and the display performance may be further improved.

Figure 9:
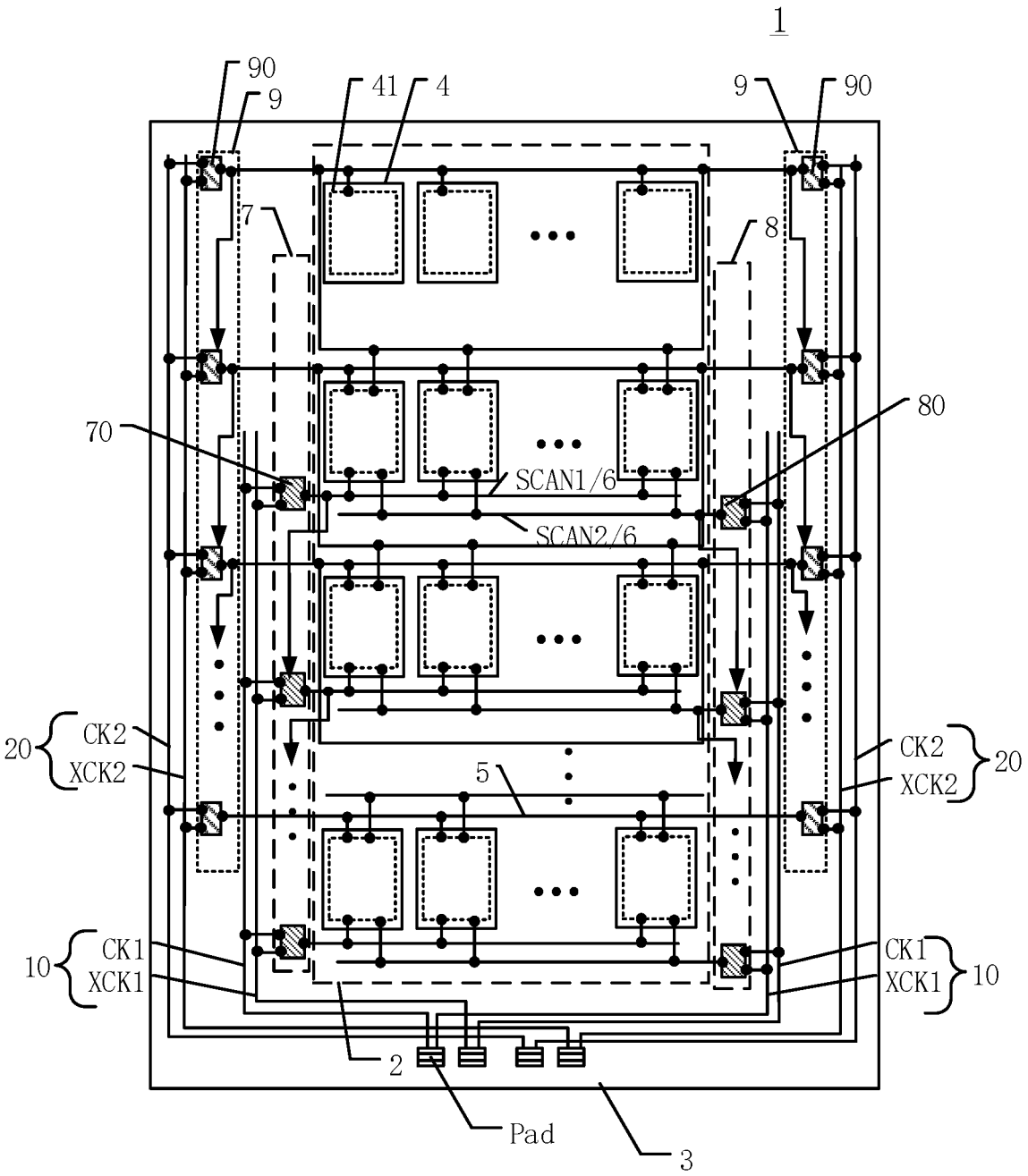
FIG. 9 illustrates a top view of another exemplary display panel consistent with disclosed embodiments.

FIG. 9 illustrates a top view of another exemplary display panel consistent with disclosed embodiments. The similarities between FIG. 8 and FIG. 9 are repeated, while certain difference may be explained.

As shown in FIG. 9, the display panel 1 may further include a first clock signal line group 10 and a second clock signal line group 20. The first clock signal line group 10 may include a plurality of first main-clock signal lines CK1 and a plurality of first sub-clock signal lines XCK1, the second clock signal line group 20 may include a plurality of second main-clock signal lines CK2 and a plurality of second sub-clock signal lines XCK2. The first clock signal line group 10 may be electrically connected to the first scanning signal control circuit 7 and the second scanning signal control circuit 8, and the second clock signal line group 20 may be electrically connected to the light-emitting signal control circuit 9.

In one embodiment, in the display panel 1, the clock signal lines of the first clock signal line group 10 may be electrically connected to pads in the display panel, and the pads may transmit the electrical signal to the first clock signal line group 10. The clock signal lines of the second clock signal line group 20 may be electrically connected to the pads, and the pads may transmit the electrical signal to the second clock signal line group 20.

In one embodiment, the first main-clock signal line CK1 may be electrically connected to the first circuit unit 70, and the first sub-clock signal line XCK1 may be electrically connected to the second circuit unit 80. The second main-clock signal line CK2 and the second sub-clock signal line XCK2 may be electrically connected to the light-emitting circuit unit 90.

In one embodiment, through only configuring the first main-clock signal line CK1 and the first sub-clock signal line XCK1 to provide a set of clock signals, electrical signals may be able to be provided to the first scanning signal control circuit 7 and the second scanning signal control circuit 8.

Figure 10:
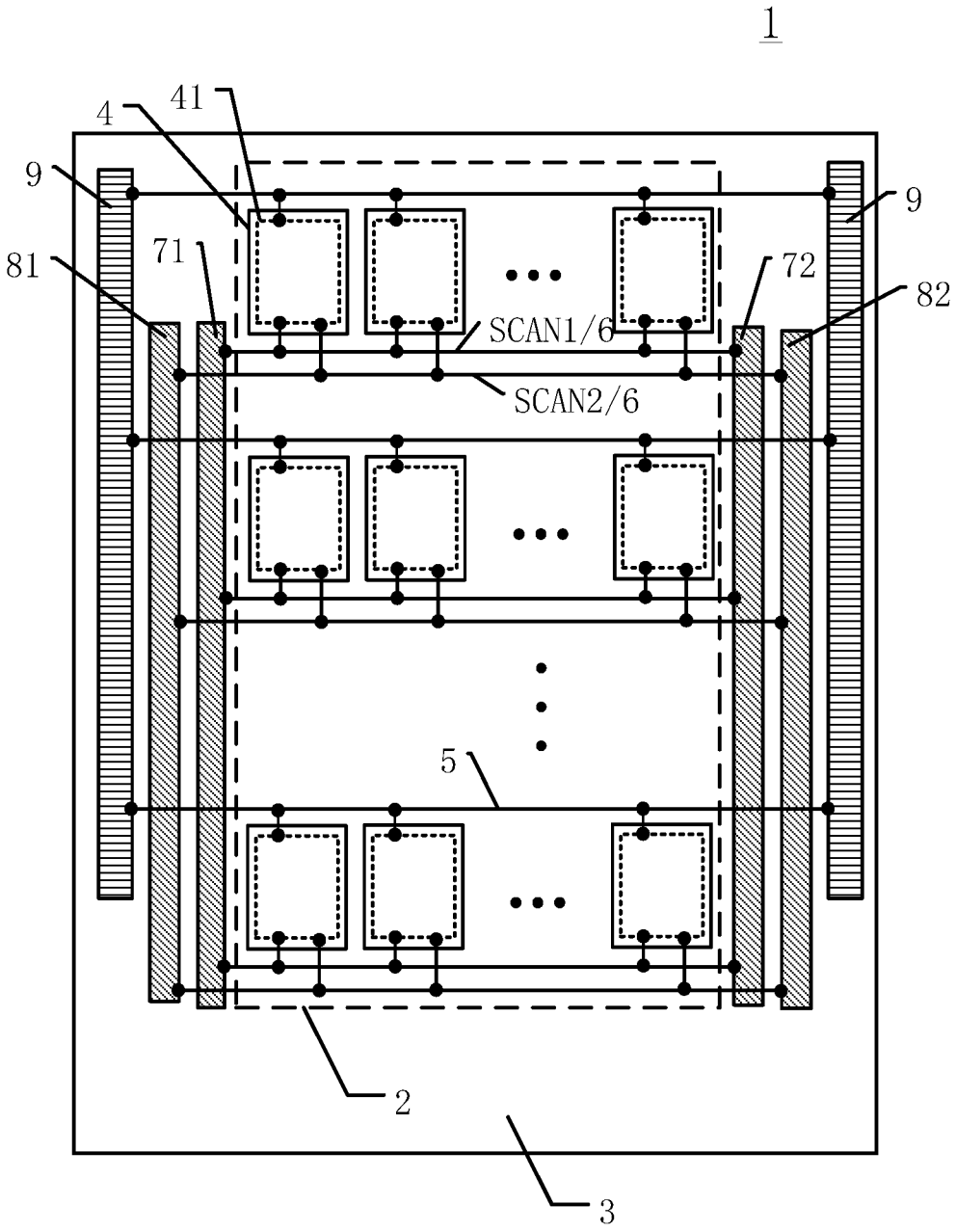
FIG. 10 illustrates a top view of another exemplary display panel consistent with disclosed embodiments.

FIG. 10 illustrates a top view of another exemplary display panel consistent with disclosed embodiments. The similarities between FIG. 10 and FIG. 8 are repeated, while certain difference may be explained.

In the disclosed embodiments, the period of the clock signal is defined as the period of the clock signal of the first clock signal line group, i.e., one clock signal period is one clock signal period of the first clock signal line group, through which the entire sequence circuit may be more ordered and standardized.

In one embodiment, as shown in FIG. 8, only one end of the first scanning signal line SCAN1 may be electrically connected to the first scanning signal control circuit 7, and only one end of the second scanning signal line SCAN2 may be electrically connected to the second scanning signal control circuit 8, where such a driving mode for driving the scanning signal line is unilaterally driven.

In another embodiment, in the display panel, the driving mode of driving the scanning signal line may be bilaterally driving, i.e., both ends of the scanning signal line may be simultaneously electrically connected to the scanning signal control circuit. The corresponding structure is shown in FIG. 10.

As shown in FIG. 10, the first scanning signal control circuit 7 may further include a third sub-scanning signal control circuit 71 and a fourth sub-scanning signal control circuit 72 disposed on opposite sides of the display panel 1. The second scanning signal control circuit 8 may further include a fifth sub-scanning signal control circuit 81 and a sixth sub-scanning signal control circuit 82 disposed on opposite sides of the display panel 1.

One end of the first scanning signal line SCAN1 may be electrically connected to the third sub-scanning signal control circuit 71, and another end of the first scanning signal line SCAN1 may be electrically connected to the fourth sub-scanning signal control circuit 72. One end of the second scanning signal line SCAN2 may be electrically connected to the fifth sub-scanning signal control circuit 81, and another end of the second scanning signal line SCAN2 may be electrically connected to the sixth sub-scanning signal control circuit 82.

As shown in FIG. 10, the driving mode of the scanning signal line is bilateral driving, in which the third sub-scanning signal control circuit 71 and the fourth sub-scanning signal control circuit 72 may simultaneously provide an electric signal to the first scanning signal line SCAN1, and the fifth sub-scanning signal control circuit 81 and the sixth sub-scanning signal control circuit 82 may simultaneously provide an electrical signal to the second scanning signal line SCAN2. Both ends of the scanning signal line may receive the electrical signal simultaneously, such that the transmission of the electrical signal on the scanning signal line may be more uniform, and the signal attenuation caused by the transmission of the electrical signal from only one end of the scanning signal line may be suppressed. Accordingly, the signal uniformity of the signal on the scanning signal line may be improved, and the operating performance of the pixel driving circuit may be enhanced. In addition, the beneficial effect of bilateral driving may be more pronounced as the size of the display panel increases.

In the disclosed embodiments, the specific circuit structures of the first scanning signal control circuit and the second scanning signal control circuit are not limited by the present disclosure. In practical applications, the specific circuit structures of the first scanning signal control circuit and the second scanning signal control circuit may be determined according to various application scenarios. For example, in the display panel shown in FIG. 10, any one of the first scanning signal control circuit 7, the second scanning signal control circuit 8, and the light-emitting signal control circuit 9 may have the electrical connection structure shown in FIG. 8 or FIG. 9.

The present disclosure also provides a display device comprising any one of the disclosed display panels.

Figure 11:
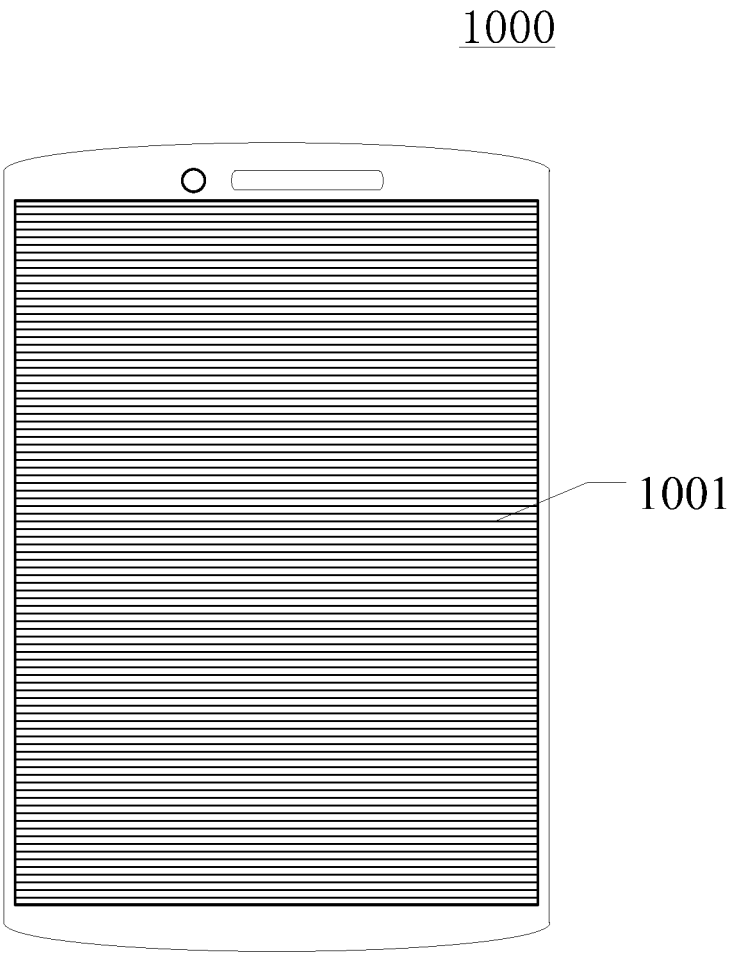
FIG. 11 illustrates an exemplary display device consistent with disclosed embodiments.

FIG. 11 illustrates an exemplary display device 1000 consistent with disclosed embodiments. As shown in FIG. 11, the display device 1000 provided may include a display panel 1001 which may be any one of the disclosed display panels. FIG. 11 shows the display device 1000 may be a mobile phone, which is for illustrative purposes and is not intended to limit the scope of the present disclosure. The display device 1000 may be any appropriate display devices, such as a computer, a television, or a car display device having a display function, which is not limited by the present disclosure.

Because the display device 1000 comprises any one of the disclosed display panels, the display device 1000 may exhibit similar features as the disclosed display panel, which will not be repeated here.

In the disclosed embodiments, the driving scheme of the pixel driving circuit may be adjusted, i.e., at least one clock signal period may be provided after the initialization is completed and before the threshold voltage deviation is compensated. Thus, the timing for capturing the threshold of the driving transistor DT may be arranged away from the lower stage (i.e., a stage changing from high-level to low-level) of the first light-emitting signal line EMIT1 and the second light-emitting signal line EMIT2. Thus, the compensation effect of the threshold voltage of the driving transistor DT may be improved, uneven vertical stripes on the display screen may be effectively suppressed, and the display performance may be enhanced.

Various embodiments have been described to illustrate the operation principles and exemplary implementations. It should be understood by those skilled in the art that the present disclosure is not limited to the specific embodiments described herein and that various other obvious changes, rearrangements, and substitutions will occur to those skilled in the art without departing from the scope of the disclosure. Thus, while the present disclosure has been described in detail with reference to the above described embodiments, the present disclosure is not limited to the above described embodiments, but may be embodied in other equivalent forms without departing from the scope of the present disclosure, which is determined by the appended claims.

What is claimed is:

1. A driving method for a pixel driving circuit comprising a driving transistor and a light-emitting element, comprising:

in response to a first scanning signal on a first scanning signal line, performing an initialization of the pixel driving circuit, wherein the first scanning signal is a low-level signal;

in response to a second scanning signal on a second scanning signal line and a third scanning signal on the first scanning signal line, compensating a threshold voltage deviation of the driving transistor, and providing a data signal voltage, wherein the third scanning signal is a low-level signal;

in response to a first light-emitting signal on a first light-emitting signal line and a second light-emitting signal on a second light-emitting signal line, generating, by the driving transistor, driving current corresponding to the data signal voltage; and in response to the driving current, emitting light by the light-emitting element, wherein at least one clock signal period is provided after the initialization of the pixel driving circuit is completed and before the threshold voltage deviation of the driving transistor is compensated, and in the at least one clock signal period, a high-level is provided to the first scanning signal line, and a signal provided to the first light-emitting signal line is changed from a high-level to a low-level.

2. The driving method according to claim 1, wherein:

two one clock signal periods are provided after the initialization of the pixel driving circuit is completed and before the threshold voltage deviation of the driving transistor is compensated.

3. The driving method according to claim 1, wherein:

the first scanning signal line provides two adjacent scanning signals, and the two adjacent signals are separated by the at least one clock signal period.

4. The driving method according to claim 1, wherein:

during the at least one clock signal period, the first light-emitting signal line at least outputs a low-level light-emitting signal.

5. The driving method according to claim 1, wherein:

the first light-emitting signal on the first light-emitting signal line has a duty cycle of approximately 25%, and the second light-emitting signal on the second light-emitting signal line has a duty cycle of approximately 25%.

6. A driving method for a pixel driving circuit comprising a driving transistor, a light-emitting element, a first transistor, a second transistor, a third transistor, a fourth transistor, a fifth transistor, and a sixth transistor, wherein:

a gate electrode of the first transistor is electrically connected to a first light-emitting signal line, a first electrode of the first transistor is electrically connected to a first voltage signal line, and a second electrode of the first transistor is electrically connected to a first electrode of the driving transistor;

a gate electrode of the second transistor is electrically connected to a second light-emitting signal line, a first electrode the second transistor is electrically connected to the first voltage signal line, and a second electrode the second transistor is electrically connected to a second node;

a gate electrode of the driving transistor is electrically connected to a first node, and the second node is electrically connected to a third node;

a gate electrode of the third transistor is electrically connected to a first scanning signal line, a first electrode of the third transistor is electrically connected to the first node, and a second electrode of the third transistor is electrically connected to the third node;

a gate electrode of the fourth transistor is electrically connected to a second scanning signal line, a first electrode of the fourth transistor is electrically connected to a data signal line, and a second electrode of the fourth transistor is electrically connected to the second node;

a gate electrode of the fifth transistor is electrically connected to the second light-emitting signal line, a first electrode of the fifth transistor is electrically connected to the third node, and a second electrode of the fifth transistor is electrically connected to the light-emitting element; and a gate electrode of the sixth transistor is electrically connected to a first scanning signal line, a first electrode of the sixth transistor is electrically connected to an initialization signal line, and a second electrode of the sixth transistor is electrically connected to the light-emitting element, wherein the driving method comprises:

in response to a first scanning signal on the first scanning signal line, performing an initialization of the pixel driving circuit, wherein the first scanning signal is a low-level signal;

in response to a second scanning signal on the second scanning signal line and a third scanning signal on the first scanning signal line, compensating a threshold voltage deviation of the driving transistor, and providing a data signal voltage, wherein the third scanning signal is a low-level signal;

in response to a first light-emitting signal on the first light-emitting signal line and a second light-emitting signal on the second light-emitting signal line, generating, by the driving transistor, driving current corresponding to the data signal voltage; and in response to the driving current, emitting light by the light-emitting element, wherein at least one clock signal period is provided after the initialization of the pixel driving circuit is completed and before the threshold voltage deviation of the driving transistor is compensated, and in the at least one clock signal period, a high-level is provided to the first scanning signal line, and a signal provided to the first light-emitting signal line is changed from a high-level to a low-level.

7. The driving method according to claim 6, wherein:

two one clock signal periods are provided after the initialization of the pixel driving circuit is completed and before the threshold voltage deviation of the driving transistor is compensated.

8. The driving method according to claim 6, wherein:

the first scanning signal line provides two adjacent scanning signals, and the two adjacent signals are separated by the at least one clock signal period.

9. The driving method according to claim 6, wherein:

during the at least one clock signal period, the first light-emitting signal line at least outputs a low-level light-emitting signal.

10. The driving method according to claim 6, wherein:

the first light-emitting signal on the first light-emitting signal line has a duty cycle of approximately 25%, and the second light-emitting signal on the second light-emitting signal line has a duty cycle of approximately 25%.

11. A display panel comprising a plurality of pixel driving circuits, wherein a pixel driving circuit of the plurality of pixel driving circuits comprises a driving transistor and a light-emitting element, and is driven by a driving method comprising: in response to a first scanning signal on a first scanning signal line, performing an initialization of the pixel driving circuit, the first scanning signal being a low-level signal; in response to a second scanning signal on a second scanning signal line and a third scanning signal on the first scanning signal line, compensating a threshold voltage deviation of the driving transistor, and providing a data signal voltage, the third scanning signal being a low-level signal; in response to a first light-emitting signal on a first light-emitting signal line and a second light-emitting signal on a second light-emitting signal line, generating, by the driving transistor, driving current corresponding to the data signal voltage; and in response to the driving current, emitting light by the light-emitting element, wherein at least one clock signal period is provided after the initialization of the pixel driving circuit is completed and before the threshold voltage deviation of the driving transistor is compensated, and in the at least one clock signal period, a high-level is provided to the first scanning signal line, and a signal provided to the first light-emitting signal line is changed from a high-level to a low-level, wherein the display panel comprises: a display area including a plurality of pixel units arranged in an array, a plurality of light-emitting signal lines, and a plurality of scanning signal lines, wherein: a pixel unit of the plurality of pixel units includes the pixel driving circuit, the plurality of scanning signal lines include a plurality of first scanning signal lines and a plurality of second scanning signal lines, and the pixel driving circuits in the same row are electrically connected to a first scanning signal line and a second scanning signal line; and a non-display area including a first scanning signal control circuit, a second scanning signal control circuit, and a light-emitting signal control circuit, wherein: the first scanning signal control circuit is electrically connected to the plurality of first scanning signal lines, the second scanning signal control circuit is electrically connected the plurality of second scanning signal lines, and the light-emitting signal control circuit is electrically connected to the plurality of light-emitting signal lines.

12. The display panel according to claim 11, wherein:

in a period of one frame, the first scanning signal line provides two adjacent scanning signals with an interval.

13. The display panel according to claim 12, wherein:

the interval between the two adjacent scanning signals includes at least one clock signal period.

14. The display panel according to claim 13, further comprising:

a first clock signal line group include a plurality of first main-clock signal lines and a plurality of first sub-clock signal lines; and a second clock signal line group including a plurality of second main-clock signal lines and a plurality of second sub-clock signal lines, wherein the first clock signal line group is electrically connected to the first scanning signal control circuit and the second scanning signal control circuit, and the second clock signal line group is electrically connected to the light-emitting signal control circuit.

15. The display panel according to claim 14, wherein:

one clock signal period is one clock signal period of the first clock signal line group.

16. The display panel according to claim 11, wherein:

the first scanning signal control circuit includes a third sub-scanning signal control circuit and a fourth sub-scanning signal control circuit disposed on opposite sides of the display panel; and the second scanning signal control circuit includes a fifth sub-scanning signal control circuit and a sixth sub-scanning signal control circuit disposed on opposite sides of the display panel, wherein one end of the first scanning signal line is electrically connected to the third sub-scanning signal control circuit, and another end of the first scanning signal line is electrically connected to the fourth sub-scanning signal control circuit, and one end of the second scanning signal line is electrically connected to the fifth sub-scanning signal control circuit, and another end of the second scanning signal line is electrically connected to the sixth sub-scanning signal control circuit.

17. A display device comprising a display panel according to claim 11.

* * * * *